United States Patent [19]

Rumbaugh

[11] Patent Number: 4,793,417

[45] Date of Patent: Dec. 27, 1988

[54] APPARATUS AND METHODS FOR CLEANING WELL PERFORATIONS

[75] Inventor: William D. Rumbaugh, Carrollton, Tex.

[73] Assignee: Otis Engineering Corporation, Dallas, Tex.

[21] Appl. No.: 86,877

[22] Filed: Aug. 19, 1987

[51] Int. Cl.[4] ..... E21B 21/00

[52] U.S. Cl. ..... 166/312; 166/331

[58] Field of Search ..... 166/311, 312, 386, 126, 166/128, 131, 151, 317, 321, 332

[56] References Cited

U.S. PATENT DOCUMENTS

| | | | |
|---|---|---|---|
| 2,962,097 | 11/1960 | Dollison | 166/136 |
| 3,182,726 | 5/1965 | Stone, Jr. | 166/313 X |
| 3,207,222 | 9/1965 | Tamplen | 166/136 |
| 3,208,531 | 9/1965 | Tamplen | 166/125 |
| 3,285,485 | 11/1966 | Slator | 226/172 |
| 3,313,346 | 4/1967 | Cross | 166/.5 |
| 3,559,905 | 2/1971 | Palynchuk | 242/54 |
| 3,743,021 | 7/1973 | McCanley et al. | 166/311 |
| 3,779,263 | 12/1973 | Edwards et al. | 166/311 X |
| 4,142,583 | 3/1979 | Brieger | 166/311 |
| 4,285,402 | 8/1981 | Brieger | 166/311 |

OTHER PUBLICATIONS

Coil Tubing, Nitrogen Cut Workover Costs, World Oil Feb. 1, 1970.

*Primary Examiner*—Stephen J. Novosad
*Assistant Examiner*—William P. Neuder
*Attorney, Agent, or Firm*—Thomas R. Felger

[57] ABSTRACT

A system for cleaning perforations in a well bore by surging formation fluid through the perforations. A wireline retrievable well tool is installed in the well bore above the perforations to establish a fluid barrier which will divide the well bore into a first fluid pressure zone and a second fluid pressure zone. The well tool includes a flow path closure device which will suddenly open when the difference in pressure between the first zone and the second zone exceeds a preselected value. The sudden opening of the closure device results in a surge of fluid flow from the downhole formation which cleans the perforations.

23 Claims, 4 Drawing Sheets

APPARATUS AND METHODS FOR CLEANING WELL PERFORATIONS

BACKGROUND OF THE INVENTION

This invention relates to apparatus and methods for stimulating oil and gas production from underground hydrocarbon producing formations. The invention is particularly adapted to generate a high intensity surge of formation fluids into a well bore to clean out perforations extending from the well bore into the surrounding formation and communicating fluids therebetween.

DESCRIPTION OF THE PRIOR ART

It has been common practice for many years to run a continuous reeled pipe (known extensively in the industry as "coil tubing") into a well to perform operations utilizing the circulation of treating fluids such as water, oil, acid, corrosion inhibitors, cleanout fluids, hot oil, and like fluids. Coil tubing being continuous rather than jointed is run into and out of a well with continuous movement of the tubing through use of a coil tubing injector.

U.S. Pat. No. 3,285,485 issued to Damon T. Slator on Nov. 15, 1966 disclosing a device for handling tubing and the like. This device is capable of injecting reeled tubing into a well through suitable seal means, such as a blowout preventor or stripper, and is commonly known as a coil tubing injector U.S. Pat. No. 3,313,346 issued Apr. 11, 1967 to Robert V. Cross and discloses methods and apparatus for working in a well using coil tubing. U.S. Pat. No. 3,559,905 issued to Alexander Palynchuk on Feb. 2, 1971 disclosing an improved coil tubing injector. U.S. Pat. No. 4,142,583 issued Mar. 6, 1979 and U.S. Pat. No. 4,285,402 issued Aug. 25, 1981 both to Emmet F. Brieger disclosing apparatus and methods for cleaning well perforations. These patents were the starting point for the research which led to the present invention. They are very important with respect to defining the scope of the present invention and its significance in the art of cleaning well perforations.

The preceding patents are incorporated by reference for all purposes within this application.

Hydrocarbons (oil and gas) are typically produced from an underground formation (reservoir) by drilling a well bore from the surface through at least a portion of the formation. The well bore is usually lined by a casing string which is cemented in place to prevent undesired fluid migration between the exterior of the casing string and adjacent earth formations. Shaped explosive charges are frequently used to form perforations through the casing, cement sheath, and into the desired hydrocarbon producing formation. The perforations allow formation fluids to flow into the well bore defined by the casing string. One or more tubing strings, production packers, and downhole flow control device are generally installed within the casing string to direct formation fluid flow to the well surface in a safe manner as required by good engineering practices. Formation fluids may include crude oil, natural gas, salt water, paraffin, hydrogen sulfide, and many other chemical compounds and elements. Perforations may become partially or fully plugged by metal particles from the explosive charge, sand from the producing formation, paraffin, or mineral deposits.

SUMMARY OF THE INVENTION

The present invention is directed towards improved methods and apparatus for cleaning well perforations using coil tubing and a wireline retrievable well tool.

The present invention is directed towards surging formation fluid flow from a first fluid pressure zone into a second fluid pressure zone within a well bore to clean the well perforations. The wireline retrievable well tool of the present invention establishes the fluid barrier in a safe, controlled, reliable manner until a preselected differential pressure is reached between the first zone and the second zone.

The present invention provides complete control over the rate of pressure change in the second fluid pressure zone. Therefore, well safety and control are maintained throughout the process of surging formation fluids through the perforations.

The wireline retrievable well tool of the present invention has a greatly increased flow area to maximize the benefits of surging formation fluid flow to clean perforations and improve well productivity. The use of conventional wireline service tools and methods to install and retrieve the well tool of the present invention results in a cost effective, economical well maintenance to improve formation productivity.

Additional objects and advantages of the present invention will be readily apparent to those skilled in the art after studying the written description in conjunction with the drawings and claims.

DESCRIPTION OF THE PREFERRED EMBODIMENT

Figures 1, 3, 4:
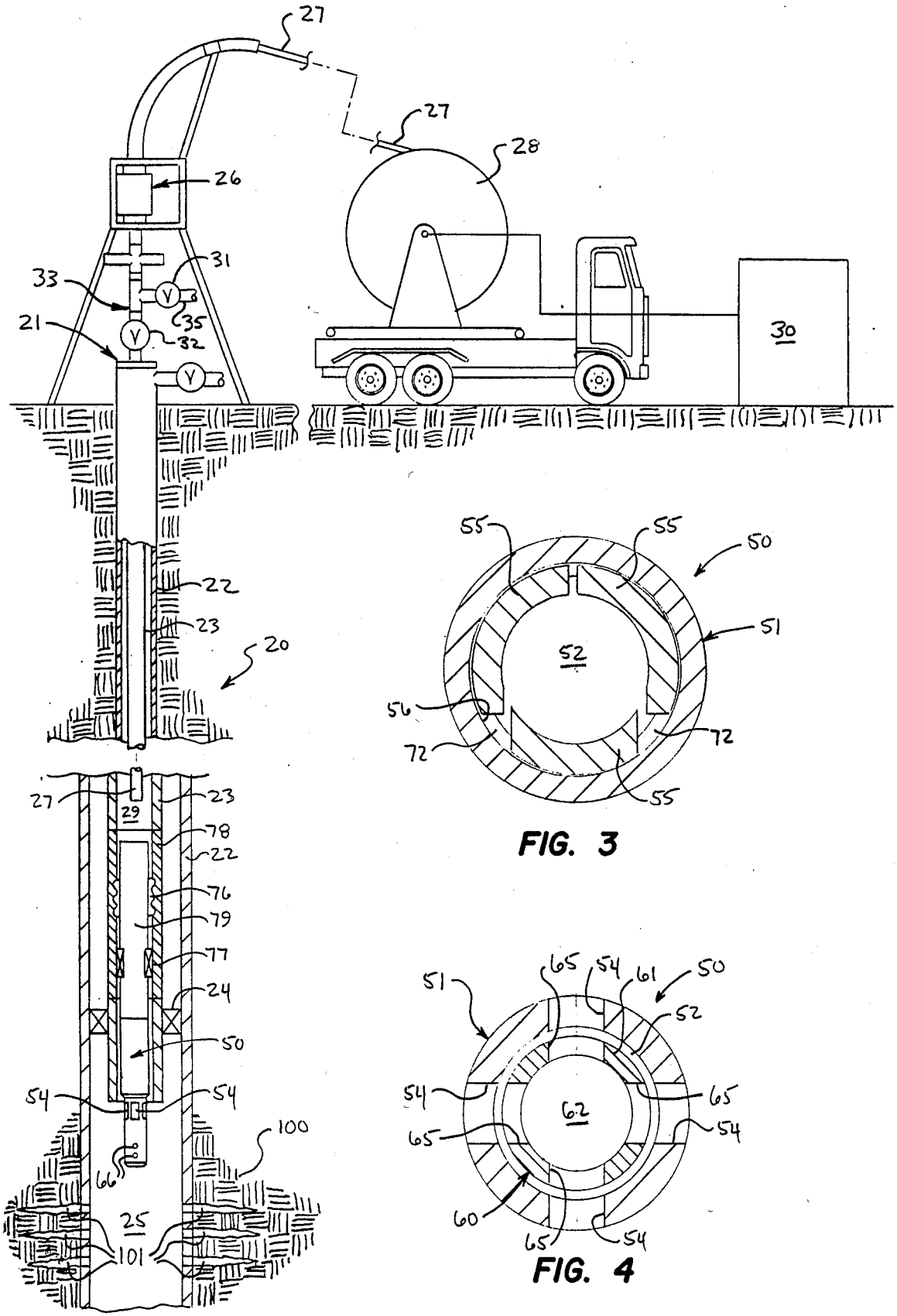
FIG. 1 is a schematic drawing partially in elevation and partially in section with portions broken away showing a coil tubing unit and wireline retrievable well tool cleaning perforations in a typical well completion.
FIG. 3 is a drawing in section taken along line 3—3 of FIGS. 2A and 2B.
FIG. 4 is a drawing in section taken along line 4—4 of FIGS. 2A and 2B.

In FIG. 1, well 20 extends from wellhead 21 to an underground hydrocarbon or fluid producing formation 100. Well 20 is defined in part by casing string 22. Tubing string 23 is disposed within casing string 22. Well packer 24 forms a fluid barrier between tubing 23 and casing 22 to direct formation fluid flow to the well surface via tubing 23. Perforations 101 extend through casing 22 below production packer 24 and into formation 100. Perforations 101 allow fluid communication between well bore 25 defined by casing 22 and formation 100 adjacent thereto.

During the production of formation fluids, various types of deposits may accumulate within well perforations 101. Examples of soft deposits are clay, paraffin and sand. Examples of hard deposits are silicates, sulphates, sulphides, carbonates and calcium. Well perforations 101 may also be plugged by residue from the explosive shaped charges which are typically used to initially form them.

Figure 9:
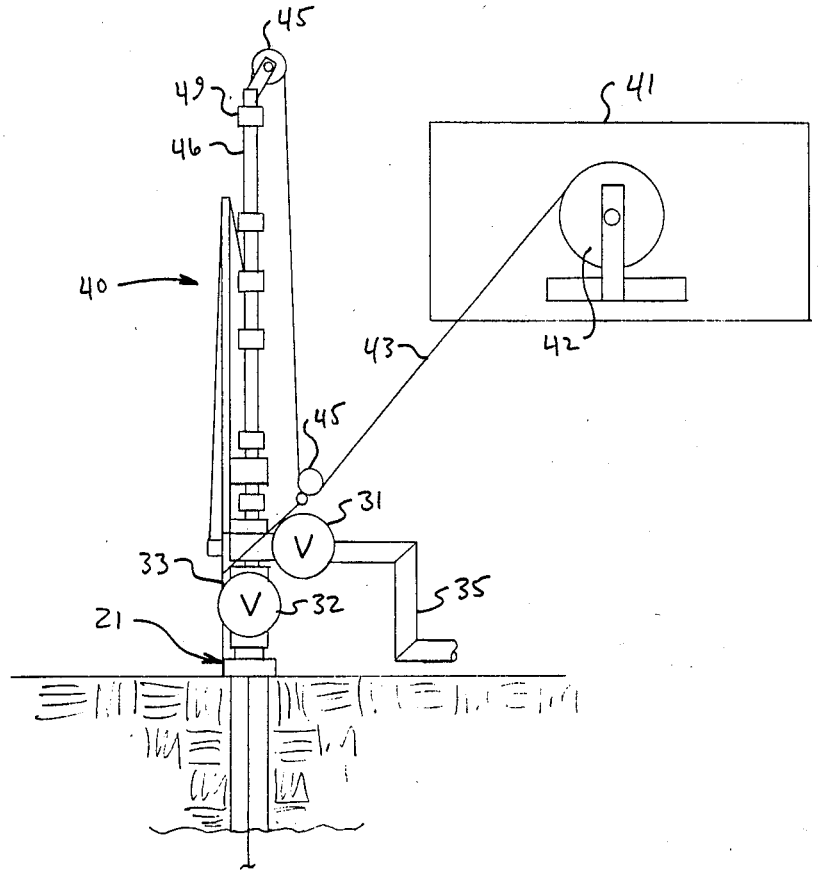
FIG. 9 is a schematic drawing of wireline service equipment attached to a Christmas tree on a wellhead.

FIG. 9 shows wellhead 21 with typical wireline servicing equipment 40 attached thereto. Conventional wireline servicing techniques can be used to install and retrieve well tools 50 and 80 which contain alternative embodiments of the present invention. Well tools 50 and 80 will be described later in more detail.

Wireline servicing of well 20 would generally involve closing wing valve 31 and master valve 32 to isolate fluids from Christmas tree 33 on top of wellhead 21. Wireline unit 41 including reel 42 and the required motors, gauges, controls, etc., (not shown) would be positioned in the vicinity of wellhead 21. Wireline 43 from reel 42 is led through pulleys 45 and stuffing box 49 into lubricator 46. A wireline tool string (not shown) including a rope socket, weight bars, swivel joints, jars, and a running or pulling tool would be attached to the end of wireline 43 within lubricator 46. Well tool 50 or 80 would then be attached to the wireline tool string by the running tool (not shown). Lubricator 46 would be secured to Christmas tree 33, master valve 33 opened, and the wireline tool string lowered to the desired depth in the well bore by wireline unit 41.

After perforations 101 have been cleaned using the methods and apparatus of the present invention, similar wireline techniques can be used to attach a pulling tool (not shown) to the tool string and retrieve well tool 50 to 80 from its downhole location. Examples of running tools are shown in U.S. Pat. Nos. 3,207,222 and 3,208,531 both to Jack W. Tamplen. An example of a pulling tool is shown in U.S. Pat. No. 2,962,097 to W. W. Dollison. These patents also contain additional information on wireline servicing techniques. The above referenced patents are incorporated by reference for all purposes within this application.

Figure 6:
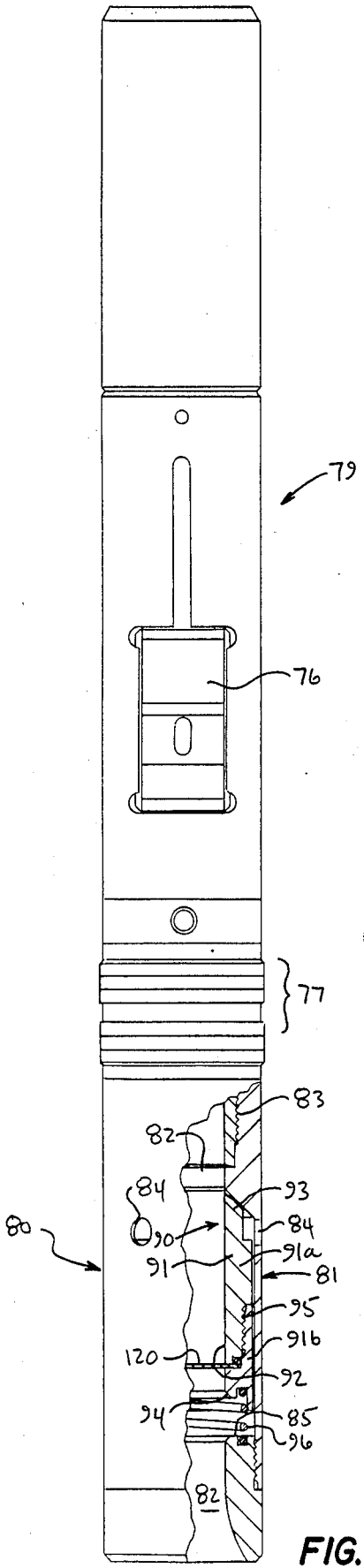
FIG. 6 is a drawing partially in elevation and partially in section with portions broken away showing the well tool of FIG. 5 in its first position blocking formation fluid flow therethrough.

Apparatus including well tool 50 for cleaning downhole perforations 101 is shown in FIG. 1. Locking mandrel 79 provides means for releasably anchoring the apparatus at a downhole location in well bore 25. Landing nipple 7 which comprises an integral part of tubing string 23 defines the downhole location. A locking mandrel and landing nipple satisfactory for use with the present invention are disclosed in U.S. Pat. No. 3,208,531. Wireline locking mandrel 79 is shown in more detail in FIG. 6.

Seal means 77 are carried on the exterior of locking mandrel 79 to establish a fluid barrier with a seal surface on the interior of landing nipple 78 adjacent thereto. Keys or dogs 76, carried by locking mandrel 79, can be releasably engaged with matching grooves on the interior of landing nipple 78.

The various components and subassemblies which comprise well tool 50 are attached to or carried by housing means 51 with longitudinal flow passageway 52 extending therethrough. Threads 53 are machined in one end of housing means 51 to engage locking mandrel 79 with well tool 50. First port means 54 extend radially through housing means 51 intermediate the ends thereof. Thus, first port means 54 are located below seal means 77 of locking mandrel 79. First port means 54 provide fluid communication between longitudinal flow passageway 52 and well bore 25 below the fluid barrier defined in part by seal means 77.

Figures 2A, 2B:
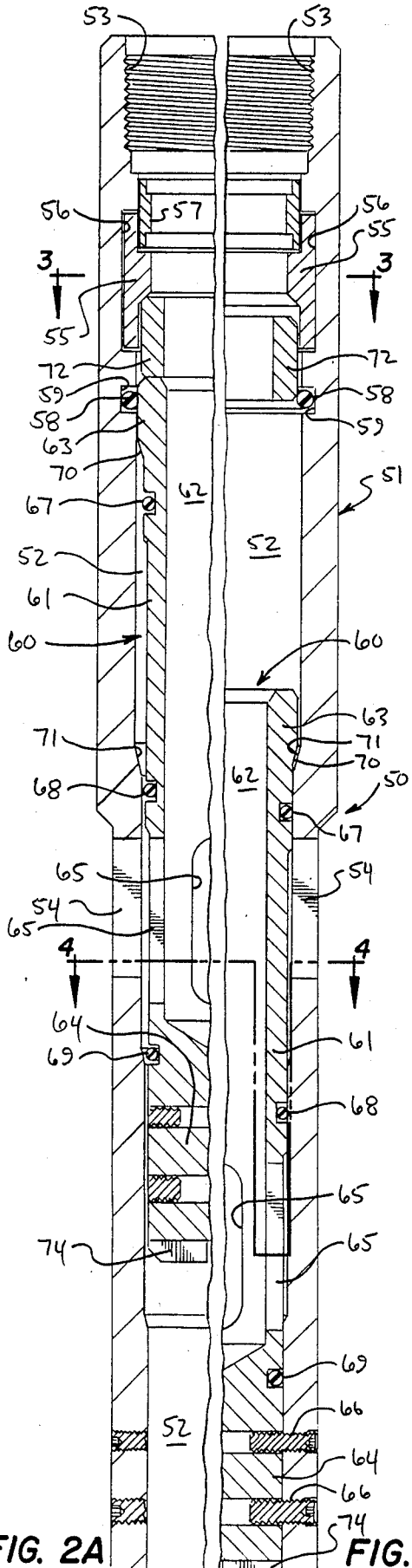
FIG. 2A is a drawing in longitudinal section with portions broken away showing the well tool of FIG. 1 in its second position which allows formation fluid flow therethrough.
FIG. 2B is a drawing in longitudinal section with portions broken away showing the well tool of FIGS. 1 and 2A in its first position which blocks formation fluid flow therethrough.

Valve closure means 60 is slidably disposed within longitudinal flow passageway 52 to control fluid flow through first port means 54. FIG. 2B shows valve closure means 60 in its first position which blocks fluid communication through first port means 54. FIG. 2A shows valve closure means 60 in its second position which allows fluid communication through first port means 54. Valve closure means 60 comprises sleeve 61 which is slidably disposed within longitudinal flow passageway 52. Longitudinal bore 62 extends partially through sleeve 61 whereby one end 63 is open to fluid communication with longitudinal flow passageway 52 and the other end 64 is closed. Second port means 65 extend radially through sleeve 61 intermediate ends 63 and 64. A plurality of shear pins 66 releasably holds sleeve 61 with second port means 65 offset longitudinally from first port means 54 when valve closure means 60 is in its first position. Slot 74 is machined in end 64 of sleeve 61 to assist with installation of shear pins 66.

O-ring seals 67, 68, and 69 are carried on the exterior of sleeve 61 spaced longitudinally from each other. The longitudinal spacing of o-rings 67 and 68 is selected so that they form fluid seals on opposite sides of first port mean 54 to block fluid communication therethrough when valve closure means 60 is in its first position. O-ring 69 is carried near end 64 of sleeve 61 to form a fluid seal with the interior of housing means 51 adjacent thereto when shear pins 66 engage sleeve 61 with housing means 51. Longitudinal flow passageway 52 has various inside diameters to establish the desired fluid seals when valve closure means 60 is in its first position. The variations in the inside diameters also minimize frictional drag during movement of sleeve 61.

As shown in FIG. 2B, o-rings 67, 68, and 69 cooperate to prevent fluid communication between longitudinal flow passageway 52 and the exterior of housing means 51 when valve closure means 60 is in its first position. Therefore, any difference in pressure between fluid within longitudinal flow passageway 52 and fluid exterior to first port means 54 creates a force which tends to longitudinally slide sleeve 61. If fluid pressure in longitudinal flow passageway 52 is greater than fluid pressure exterior to first port means 54, the net force acting on sleeve 61 forces shoulder 70 of one end 63 to contact tapered inside diameter portion 71 of longitudinal flow passageway 52. If fluid pressure exterior to first port means 54 is greater than fluid pressure in longitudinal flow passageway 52, the net force acting on sleeve 61 tends to move valve closure means 60 to its second position. The net force is proportional to the difference in fluid pressure times the effective piston area defined by o-ring 69. When the net force exceeds a preselected value determined by shear pins 66, the difference in pressure will shift valve closure means 60 from its first to its second position. This upward movement of sleeve 61 results in alignment of second port means 65 with first port means 54 to allow unrestricted fluid communication therethrough.

The amount of force acting on sleeve 61 can be substantial depending upon the difference in pressure and the size of shear pins 66. This force develops a significant amount of momentum in sleeve 61 while sliding valve closure means 60 from its first to its second position. Therefore, housing means 51 carries means for absorbing the momentum of sleeve 61 after second port means 65 has been aligned with first port means 54. Buffer cylinder 72 is disposed in longitudinal flow passageway 52 above sleeve 61 to receive the initial impact from end 63. Preferably, buffer cylinder 72 is made from a relatively soft metal such as brass. A plurality of stop segments 55 is disposed in recess 56 near the upper end of longitudinal flow passageway 52. Retainer ring 57 is used to releasably engage stop segments 55 with recess 56. Stop segments 55 and buffer cylinder 72 define the upper limit for movement of sleeve 61.

O-ring 58 is disposed in groove 59 formed in longitudinal flow passageway 52 near recess 56. O-ring 58 performs two holding functions. When valve closure means 60 is in its first position, o-ring 58 holds buffer cylinder 72 adjacent to stop segments 55. When valve closure means 60 is in its second position, o-ring 58 holds sleeve 61 to keep first port means 54 and second port means 65 aligned during retrieval of well tool 50 from its downhole location.

Using conventional well servicing techniques, injector 26 can be mounted on wellhead 21. Continuous or coil tubing 27 from reel 28 is inserted by injector 26 into bore 29 of tubing 23. Hydraulic power unit 30 includes the necessary pumps, manifolds, valves, and fluid reservoirs to discharge lifting fluid into bore 29 via coil tubing 27. Wing valve 31 can be used to control the return of spent lifting fluid and formation fluids to the well surface. Nitrogen is an example of one lifting fluid frequently used with coil tubing 27.

Operating Sequence

The present invention allows perforations 101 to be cleaned by surging fluid flow from formation 100 into well bore 25 via perforations 101. The initial conditions will generally be production flow from well 20 shut-in and tubing string 23 at least partially filled with formation fluids. Using wireline service equipment such as shown in FIG. 9 and conventional wireline techniques, well tool 50 can be releasably anchored by locking mandrel 79 in landing nipple 78 to establish a fluid barrier in well bore 25 above perforations 101. The fluid barrier is defined in part by well packer 24 and seal means 77 on locking mandrel 79.

Reeled tubing 27 is next inserted into tubing 23 above well tool 50. Lifting fluid such as nitrogen gas is injected into tubing bore 29 to remove formation fluids, principally crude oil, water, or other liquids, from above well tool 50. The mixture of lifting fluid and formation fluids flows out of tubing 23 via master valve 32 and wing valve 31 into surface flowline 35. Fluid pressure in tubing string 23 above well tool 50 is a function of gas pressure in tubing bore 29 plus the hydrostatic pressure of any liquids above well tool 50. Fluid pressure in a portion of the well bore defined by tubing bore 29 above well tool 50 can be decreased to a preselected value by first decreasing the liquids above well tool 50 to a desired level and then venting gas pressure. Various combinations of liquid level and gas venting can be used to obtain optimum cleaning of perforations 101. Factors which would be considered for each well include bottom hole pressure, desired surge volume, liquid density, and deposits in perforations 101.

A sufficient number, type and size of shear pins 66 is installed between housing means 51 and sleeve 61 such that valve closure means 60 will shift to its second position when the preselected fluid pressure is established in tubing bore 29. Well tool 50 is thus opened in response to the decrease in fluid pressure to suddenly establish fluid flow therethrough. The sudden opening causes a surge of fluid flow from formation 100 through perforation 101. Well tool 50 and locking mandrel 79 can be retrieved from the well bore by conventional wireline techniques.

ALTERNATIVE EMBODIMENTS

Apparatus for cleaning well perforations 101 using an alternative embodiment of the present invention is shown in FIGS. 5–8. Well tool 80 can be attached to locking mandrel 79 by threaded connection 83 and releasably anchored in landing nipple 78 in the same manner as previously described for well tool 50.

The various components and subassemblies which comprise well tool 80 are attached to or carried by housing means 81 with longitudinal flow passageway 82 extending therethrough. First port means 84 extend radially through housing means 81 intermediate the ends thereof. Thus, first port means 84 are located below seal means 77 of locking mandrel 79. First port means 84 provide fluid communication between longitudinal flow passageway 82 and well bore 25 below the fluid barrier defined in part by seal means 77 and well packer 24.

Valve closure means 90 is slidably disposed within longitudinal flow passageway 82 to control fluid flow through first port means 84. Valve closure means 90 has three positions. In its first position shown in FIG. 6, fluid communication via first port means 84 is blocked. In its second position shown in FIG. 7, fluids from longitudinal flow passageway 82 can exit from well tool 80 via first port means 84. In its third position shown in FIG. 8, frangible disk 120 has been ruptured to allow formation fluids to surge through well tool 80.

Valve closure means 90 comprises sleeve 91 which is slidably disposed within longitudinal flow passageway 82. Longitudinal bore 92 extends through sleeve 91 whereby one end 93 and the other end 94 are open to fluid communication with longitudinal flow passageway 82.

Sleeve 91 has two subassemblies **91*a* and 91*b* which are joined together by threaded connection 95. Frangible or rupture disk 120 is installed between subassemblies 91*a* and 91*b* to prevent undesired fluid flow through bore 92. Spring 96 is positioned between other end 94 of sleeve 91 and shoulder 85 of housing means 81 to bias sleeve 91 and thus valve closure means 90** to its first position.

Figure 7:
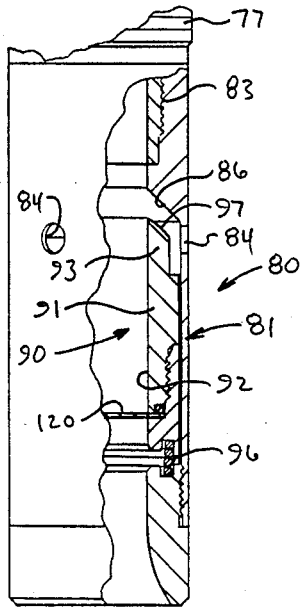
FIG. 7 is a drawing partially in elevation and partially in section with portions broken away showing the well tool of FIG. 5 in its second position which allows fluid communication therethrough.

As best shown in FIG. 7, sealing surface 97 is formed on one end 93 of sleeve 91 and valve seat 86 is formed on the interior of housing means 91 adjacent thereto. Sealing surface 97 and valve seat 86 function in a manner similar to a poppet valve to block fluid flow through first port means 84. Valve closure means 90 ca be shifted from its first to its second position by increasing the fluid pressure in bore 92 above disk 120 to a preselected value greater than fluid pressure in bore 92 below disk 120. Fluid pressure exterior to first port means 84 is equal to fluid pressure below rupture disk 120 when well tool 80 is installed in tubing string 23. The difference in pressure required to shift valve closure means 90 is proportional to the force required to overcome spring 96 divided by the effective piston area of sealing surface 97, valve seat 86, and rupture disk 120. Disk 120 functions as frangible means carried by valve closure means 90 which will rupture in response to a preselected difference in pressure between fluid within longitudinal flow passageway 22 and fluid exterior to first port means 84. Disk 120 is selected to rupture in response to a higher difference in fluid pressure than the difference in pressure required to shift valve closure means 90 to its second position. Rupture disks satisfactory for use with the present invention can be obtained from Fike Metal Products Corporation, 704 South 10th Street, P. O. Box 610, Blue Springs, Mo. 64015.

Those skilled in the art will note that both well tool 50 and well tool 80 could be releasably anchored into casing string 22 if a suitable landing nipple was a part thereof. The present invention is not limited to only well completions with a single tubing string disposed within a casing string. Well tools 50 and 80 could be attached to a slip type locking mandrel that engages the inside diameter of a well flow conductor or a locking mandrel that engages collar recesses. Also, well tools 50 and 80 could be used to clean perforations found in injection wells and geothermal wells.

Operating Sequence

Figure 5:
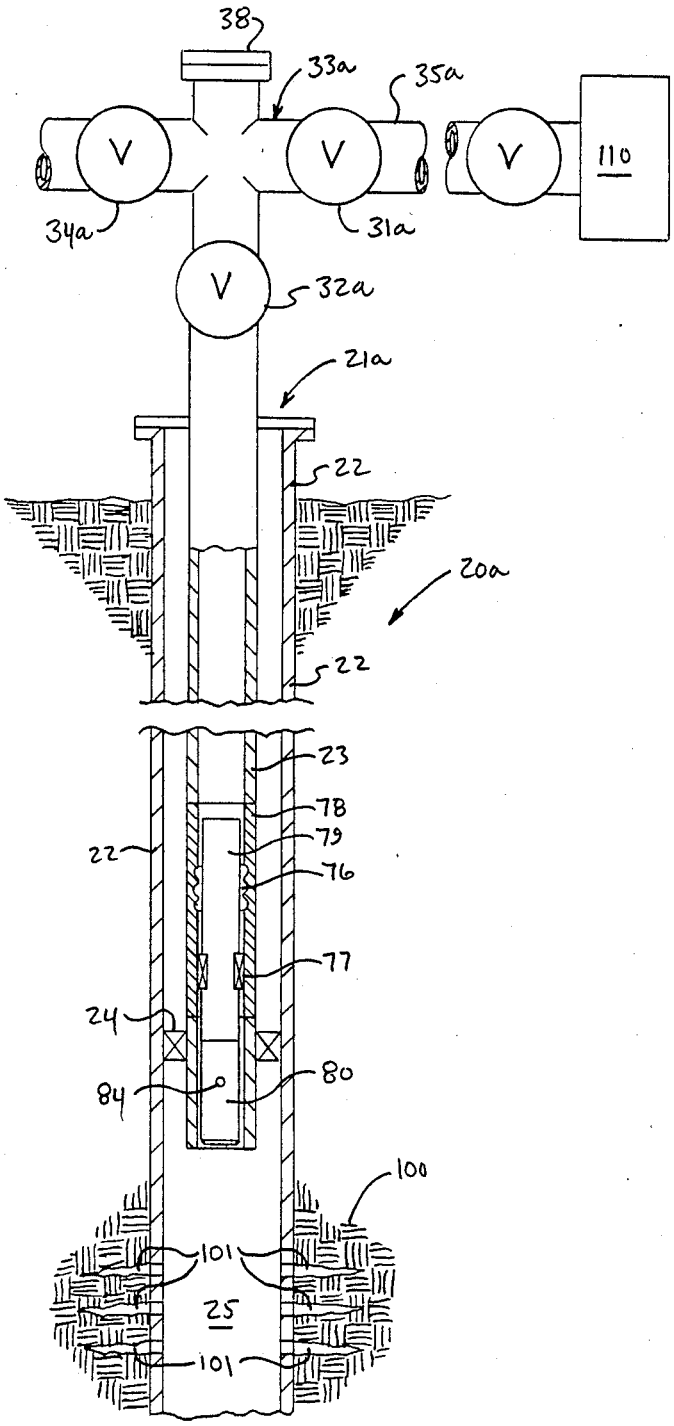
FIG. 5 is a schematic drawing partially in elevation and partially in section with portions broken away showing a well completion with an alternative embodiment of a wireline retrievable well tool for cleaning downhole perforations.

The present invention allows perforations 101 to be cleaned by surging fluid flow from formation 100 into well bore 25 via perforations 101. Referring to FIG. 5, the initial condition for well 20*a* will generally be production flow shut-in and tubing string 23 at least partially filled with formation fluids. Well cap 38 can be removed from Christmas tree 33*a* and well tool 80 releasably anchored in tubing string 23 using wireline service equipment such as shown in FIG. 9 Well tool 80, locking mandrel 79, landing nipple 78 and well packer 24 cooperate to establish a fluid barrier in well bore 25 above perforations 101.

Fluid supply unit 110 includes the necessary pumps, manifolds, valves and fluid reservoirs to provide various treating fluids to well 20*a*. Fluid supply unit 110 is connected to wellhead 21*a* via surface flowline 35*a* and wing valve 31*a*. Treating fluids can be injected from supply unit 110 into tubing string 23 via Christmas tree 33*a*. Well tool 80 functions as a spring loaded check valve. When the pressure of treating fluid plus any formation fluids in tubing string 23 above well tool 80 exceeds a preselected value, valve closure means 90 will shift to its second position. Fluids from tubing string 23 can thus be injected into formation 100 via first port means 84 and perforations 101.

Figure 8:
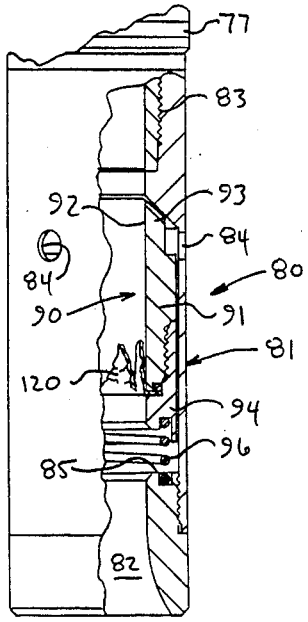
FIG. 8 is a drawing partially in elevation and partially in section with portions broken away showing the well tool of FIG. 5 in its third position which allows formation fluids to surge therethrough.

A wide variety of treating fluids might be selected for injection into formation 100. The selection would be based upon the characteristics of the formation fluid, deposits clogging perforations 101 and reservoir 100. The type of treating fluid and the surge volume may enlarge the effective area of perforations 101. Also, more than one type of treating fluid might be injected into tubing 23. For example, a sufficient quantity of acid might first be injected into tubing 23 to force all formation fluids in tubing 23 and well bore 25 below well packer 24 back into formation 100 via perforations 101. A gas such as nitrogen might then be injected into tubing string 23 to force some or all of the acid into the formation. After the injection of gas is stopped, spring 96 will return valve closure means 90 to its first position. Wing valve 34*a* can then be opened to vent the gas pressure from tubing string 23 above well tool 80. There may be a delay before opening wing valve 34*a* to allow the treating fluid to perform its intended function. Decreasing the gas pressure will establish the required difference in pressure to rupture disk 120 as shown in FIG. 8 and surge formation fluids therethrough to clean perforations 101. Any acid which was previously displaced into formation 100 would help to clean the clogged perforations during this surge. For some well conditions, a gas such as nitrogen or carbon dioxide may be used to directly force formation fluids back into reservoir 100. Well tool 80 and locking mandrel 79 can be retrieved from the downhole location using conventional wireline servicing techniques.

The previous written description and drawings describe the preferred embodiments of the present invention. Those skilled in the art will readily see alternative configurations for the apparatus and modifications to methods without departing from the scope of the invention which is defined in the following claims.

I claim:

1. Apparatus for cleaning downhole perforations which communicate fluids between a well bore and a geological formation adjacent thereto, comprising:

a. means for releasably anchoring the apparatus at a downhole location within the well bore;

b. means for establishing a fluid barrier between the exterior of the apparatus and the well bore;

c. housing means with a longitudinal flow passageway extending therethrough;

d. first port means extending radially through the housing means intermediate the ends thereof;

e. the first port means providing fluid communication between the longitudinal flow passageway and the well bore below the fluid barrier;

f. valve closure means slidably disposed within the longitudinal flow passageway having a first position which blocks fluid communication through the port means and a second position which allows fluid communication through the port means;

g. means for shifting the valve closure means between its first and second position in response to the difference in pressure between fluid within the longitudinal flow passageway and fluid exterior to the first port means;

h. the valve closure means comprising a sleeve slidably disposed within the longitudinal flow passageway;

i. a longitudinal bore extending partially through the sleeve whereby one end of the sleeve is open to fluid communication with the longitudinal flow passageway and the other end of the sleeve is closed;

j. second port means extending radially through the sleeve intermediate the ends thereof; and k. the second port means aligned with the first port means when the valve closure means is in its second position.

2. Apparatus as defined in claim 1 wherein the releasable anchoring means comprises a wireline locking mandrel attached to the housing means and a landing nipple in a well flow conductor at the downhole location.

3. Apparatus as defined in claim 2 wherein a portion of the means for establishing the fluid barrier comprises seal means on the exterior of the locking mandrel and a seal surface on the interior of the landing nipple.

4. Apparatus as defined in claim 1 wherein a portion of the means for establishing the fluid barrier comprises a first well flow conductor concentrically disposed within a second well flow conductor and a well packer forming a fluid seal between the first and second well flow conductors above the perforations.

5. Apparatus as defined in claim 1 wherein the shifting means comprises:

a. a plurality of shear means to releasably hold the sleeve with the second port means longitudinally offset from the first port means when the valve closure means is in its first position; and b. means for forming fluid seals between the exterior of the sleeve and the interior of the housing means whereby the difference in fluid pressure can overcome the shear means and slide the sleeve to align the first and second port means.

6. Apparatus as defined in claim 5 further comprising means for absorbing the momentum of the sliding sleeve after the second port means has been aligned with the first port means.

7. Apparatus as defined in claim 6 wherein the absorbing means further comprises:

a. a buffer cylinder disposed within the longitudinal flow passageway above the sleeve;

b. stop segments releasably engaged with the housing means near the upper end of the longitudinal flow passageway;

c. the stop segments and buffer cylinder cooperating to define the limit for movement of the sleeve as the difference in fluid pressure moves the valve closure means to its second position; and d. means for removing the stop segments add buffer cylinder from the longitudinal flow passageway for replacement or repair as required.

8. Apparatus as defined in claim 7 wherein the removing means comprises a retainer ring engaged with the stop segments.

9. Apparatus as defined in claim 7 further comprising means for holding the buffer cylinder spaced longitudinally from the sleeve.

10. Apparatus as defined in claim 7 further comprising means for holding the sleeve with the first port means and second port means aligned during retrieval of the apparatus from the downhole location.

11. A well tool for cleaning downhole perforations which communicate fluids between a well bore and a geological formation adjacent thereto, the well bore containing a well packer and tubing string above the perforations, and the tubing string communicating fluids between the well surface and the perforations, comprising:

a. housing means with a longitudinal flow passageway extending therethrough;

b. means for releasably anchoring the housing means at a preselected downhole location in the tubing string;

c. means for establishing a fluid barrier between the exterior of the housing means and the tubing string;

d. first port means extending radially through the housing means intermediate the ends thereof;

e. the port means providing fluid communication between the longitudinal flow passageway and the well bore below the fluid barrier;

f. valve closure means slidably disposed within the longitudinal flow passageway having a first position which blocks fluid communication through the first port means and a second position which allows fluid communication through the first port means;

g. means for shifting the valve closure means between its first and second position in response to the difference in pressure between fluid within the longitudinal flow passageway and fluid exterior to the first port means;

h. the valve closure means further comprising a sleeve slidably disposed within the longitudinal flow passageway;

i. a longitudinal bore extending partially through the sleeve whereby one end of the sleeve is open to fluid communication with the longitudinal flow passageway and the other end of the sleeve is closed;

j. second port means extending radially through the sleeve intermediate the ends thereof; and k. the second port means offset from the first port means when the valve closure means is in its first position and the second port means aligned with the first port means when the valve closure means is in its second position.

12. Apparatus as defined in claim 11 wherein the shifting means comprises:

a. a plurality of shear means to releasably hold the sleeve with the second port means offset from the first port means when the valve closure means is in its first position; and b. means for forming fluid seals between the exterior of the sleeve and the interior of the housing means whereby the difference in fluid pressure can overcome the shear means and slide the sleeve to align the first and second port means.

13. Apparatus as defined in claim 11 wherein the valve closure means further comprises:

a. a hollow sleeve slidably disposed in the longitudinal flow passageway;

b. a sealing surface formed on one end of the hollow sleeve;

c. a valve seat formed on the interior of the housing means above the first port means; and d. the sealing surface and valve seat forming a fluid barrier when engaged with each other to block fluid flow through the first port means.

14. Apparatus as defined in claim 13 further comprising:

a. the frangible means disposed within the hollow sleeve near the other end thereof; and b. biasing means including a spring disposed between the other end of the hollow sleeve and a shoulder on the interior of the housing means.

15. A well tool for cleaning downhole perforations which communicate fluids between a well bore and geological formation adjacent thereto, the well bore defined in part by a casing string, a tubing string disposed within the casing string, and a well packer forming a fluid barrier between tubing string and casing string above the perforations, comprising:

a. housing means with a longitudinal flow passageway extending therethrough;

b. means for releasably anchoring the housing means at a preselected downhole location in the tubing string;

c. means for establishing a fluid barrier between the exterior of the housing means and the tubing string;

d. first port means extending radially through the housing means intermediate the ends thereof;

e. the port means providing fluid communication between the longitudinal flow passageway and the well bore below the fluid barrier;

f. valve closure means slidably disposed within the longitudinal flow passageway having a first position which blocks fluid communication through the first port means and a second position which allows fluid communication through the first port means;

g. means for shifting the valve closure means between its first and second position in response to the difference in pressure between fluid within the longitudinal flow passageway and fluid exterior to the first port means;

h. means for biasing the valve closure means to its first position; and i. frangible means carried by the valve closure means which will rupture in response to a preselected difference in pressure between fluid within the longitudinal flow passageway and fluid exterior to the first port means.

16. A cell tool as defined in claim 15 wherein the frangible means, after it is ruptured, permits fluid communication through the longitudinal flow passageway.

17. A well tool as defined in claim 15 wherein the valve closure means further comprises:

a. a hollow sleeve slidably disposed in the longitudinal flow passageway;

b. a sealing surface formed on one end of the hollow sleeve;

c. a valve seat formed on the interior of the housing means above the first port means; and d. the sealing surface and valve seat forming a fluid barrier when engaged with each other to block fluid flow through the first port means.

18. A well tool as defined in claim 17 further comprising:

a. the frangible means disposed within the hollow sleeve near the other end thereof; and b. the biasing means including a spring disposed between the other end of the hollow sleeve and a shoulder on the interior of the housing means.

19. A well tool as defined in claim 18 wherein the frangible means comprises a rupture disk.

20. A method for cleaning perforations, which communicate fluids between a well bore and a geological formation adjacent thereto, by developing a surge of formation fluids through the perforations, comprising:

a. releasably anchoring a well tool by wireline techniques within the well bore to establish a fluid barrier above the perforations;

b. decreasing fluid pressure to below a preselected value in a portion of the well bore above the well tool;

c. opening the well tool in response to the decrease in fluid pressure to suddenly establish fluid flow therethrough and surge fluid flow from the formation through the perforations; and d. retrieving the well tool from the well bore by wireline techniques.

21. The method for cleaning perforations as defined in claim 20 further comprising the steps of:

a. inserting reeled tubing into the well bore after releasably anchoring the well tool therein;

b. establishing fluid flow from the well bore at the well surface;

c. injecting gas via the reeled tubing into the well bore above the well tool whereby the gas displaces fluids from above the well tool;

d. stopping the injection of gas when the fluids above the well tool reach a desired level; and e. venting gas from the well bore to establish the preselected difference in pressure required to open flow through the well tool.

22. The method for cleaning perforations as defined in claim 20 further comprising the steps of:

a. injecting gas into the well bore after releasably anchoring the well tool therein;

b. forcing fluids in the well bore above the well tool back into the formation via the well tool and the perforations;

c. stopping the injection of gas when the fluids above the well tool reach a desired level; and d. venting gas from the well bore t establish the preselected difference in pressure required to open flow through the well tool.

23. The method of cleaning perforations as defined in claim 22 further comprising the step of injecting a treating fluid into the well bore before injecting the gas.

* * * * *